US007789817B2

(12) United States Patent
Wang

(10) Patent No.: US 7,789,817 B2
(45) **Date of Patent: *Sep. 7, 2010**

(54) EXERCISER FOR THE SAKE OF TRAINING THE ABDOMINAL MUSCLE GROUP

(76) Inventor: Loao Wang, No. 1, Lane 233, Sec. 2, Chamg Long Rd., Taiping (TW) 411

( * ) Notice: Subject to any disclaimer, the term of this patent is extended or adjusted under 35 U.S.C. 154(b) by 0 days.

This patent is subject to a terminal disclaimer.

(21) Appl. No.: 12/358,219

(22) Filed: Jan. 22, 2009

(65) Prior Publication Data

US 2010/0184572 A1 Jul. 22, 2010

(51) Int. Cl.
*A63B 22/14* (2006.01)

(52) U.S. Cl. ..... 482/147; 482/146

(58) Field of Classification Search ..... 482/122, 482/123, 129, 130, 146, 147, 79, 80, 133, 482/136
See application file for complete search history.

(56) References Cited

U.S. PATENT DOCUMENTS 4,390,180 A * 6/1983 Simjian ..... 482/131
5,645,512 A * 7/1997 Yu ..... 482/53
5,695,250 A * 12/1997 Lin ..... 297/353
6,582,344 B2 * 6/2003 Tang ..... 482/53
6,875,159 B2 * 4/2005 Chuang ..... 482/51
6,899,657 B2 * 5/2005 Chuang ..... 482/52
6,918,861 B2 * 7/2005 Liao et al. ..... 482/57
2003/0092546 A1 * 5/2003 Yu ..... 482/142

* cited by examiner

*Primary Examiner*—Loan Thanh
*Assistant Examiner*—Allana Lewin

(57) ABSTRACT

An exerciser for the sake of training the abdominal muscle group, wherein the operator may rotate on his backbone for taking a twisting exercise for his upper and lower bodies in reverse (different) direction; and wherein the exerciser includes a rotating disc mechanism for the lower limb of the operator to stand thereon and swiveled under application of force, a rotating handlebar mechanism for the upper limb of the operator to hold thereon and swiveled under application of force, and a coupling mechanism for synchronically and reversely coupling the rotating disc mechanism and the rotating handlebar mechanism.

2 Claims, 3 Drawing Sheets

EXERCISER FOR THE SAKE OF TRAINING THE ABDOMINAL MUSCLE GROUP

BACKGROUND OF THE INVENTION

1. Fields of the Invention

The invention relates to an exerciser for the sake of training the whole abdominal muscle group, and more particularly, to an exerciser, with which the operator may rotate on his backbone for taking a synchronic twisting exercise for his upper and lower bodies in reverse (different) direction.

2. Description of the Related Art

As well-known, the current fitting apparatuses are provided for the operator to take exercise on certain parts of his body. For example, the treadmills, the fitness bikes, the elliptical cross trainers, etc. are primarily employed to train the lower body of the operators. To the contrary, the weight-lifting exercisers, the stretching exercisers, the rowing exercisers, etc. are substantially used to train the upper body of the operator. However, it is rarely seen that an exerciser is specially employed for the operator to train his abdominal muscle group under the thoracic cavity and above the pelvis.

Of course, the so-called waist-twisting exercisers or sit-up exercisers (not shown) have been popular in the market. They are primarily employed to twist and bend the abdominal muscles. Therefore, it seems that they can be used to train the corresponding abdominal muscle group. However, the waist-twisting exerciser is so used that the lower body is twisted while the upper body is unmovable in a fixed position. As a result, the exercise substantially takes effect only on the muscles of pelvis or the part under the pelvis. For the sit-up exerciser, the exercise substantially takes effect only on the abdominal muscles. According to the above-mentioned, there still have not been exercisers specially employed for the operator to train the whole abdominal muscle group under the thoracic cavity and above the pelvis.

SUMMARY OF THE INVENTION

An object of the invention is to provide an exerciser for the sake of training the abdominal muscle group, with which the operator may rotate on his backbone for taking a twisting exercise for his upper and lower bodies in reverse (different) direction. In this way, the operator may train his abdominal muscle group under the thoracic cavity and above the pelvis According to the invention, the exerciser includes a rotating disc mechanism for the lower limb of the operator to stand thereon and swiveled under application of force, a rotating handlebar mechanism for the upper limb of the operator to hold thereon and swiveled under application of force, and a coupling mechanism for synchronically and reversely coupling the rotating disc mechanism and the rotating handlebar mechanism.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show a preferred embodiments of the invention.

Figure 1:
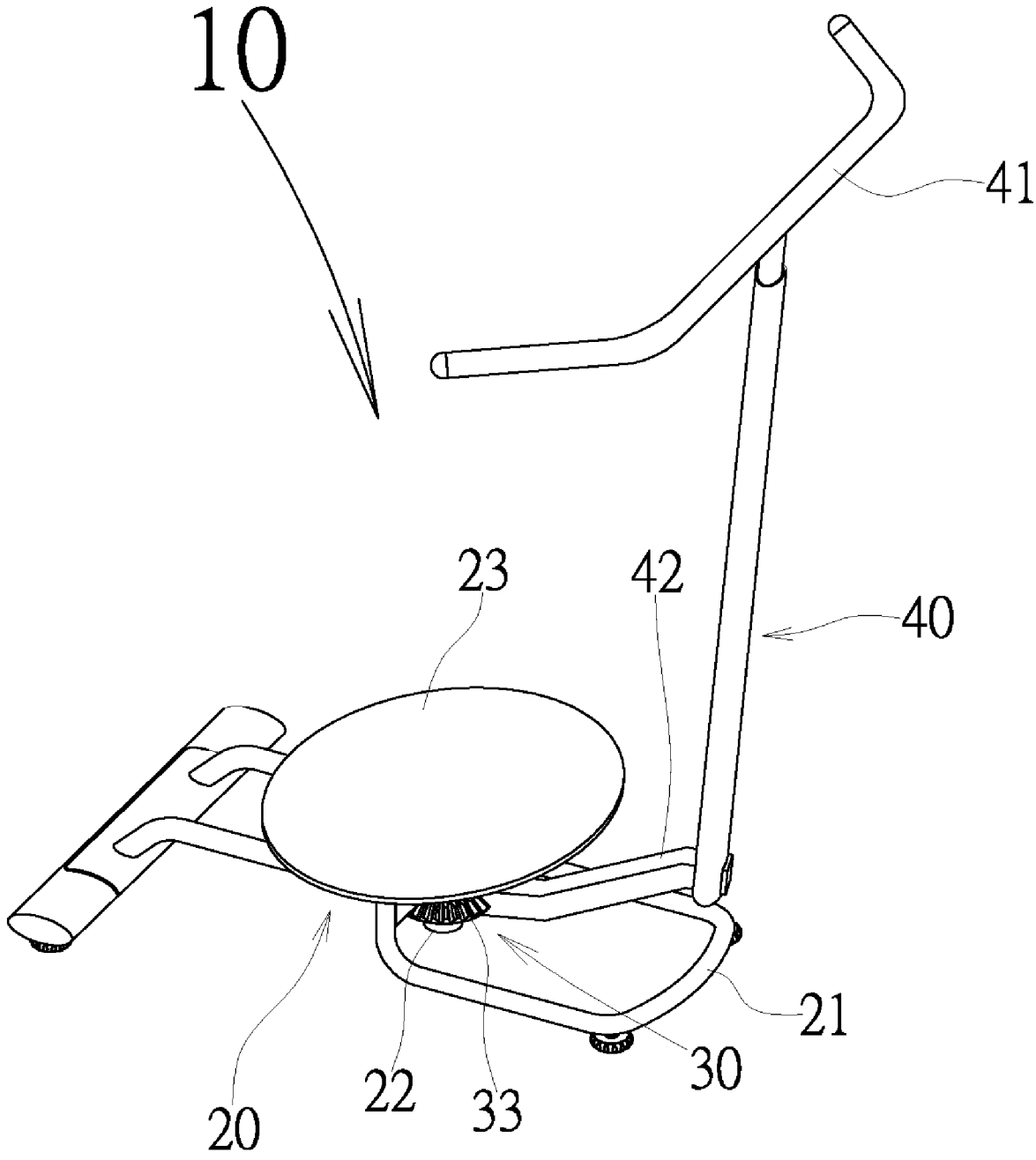
FIG. 1 is a perspective view of a preferred embodiment of the invention.
Figure 2:
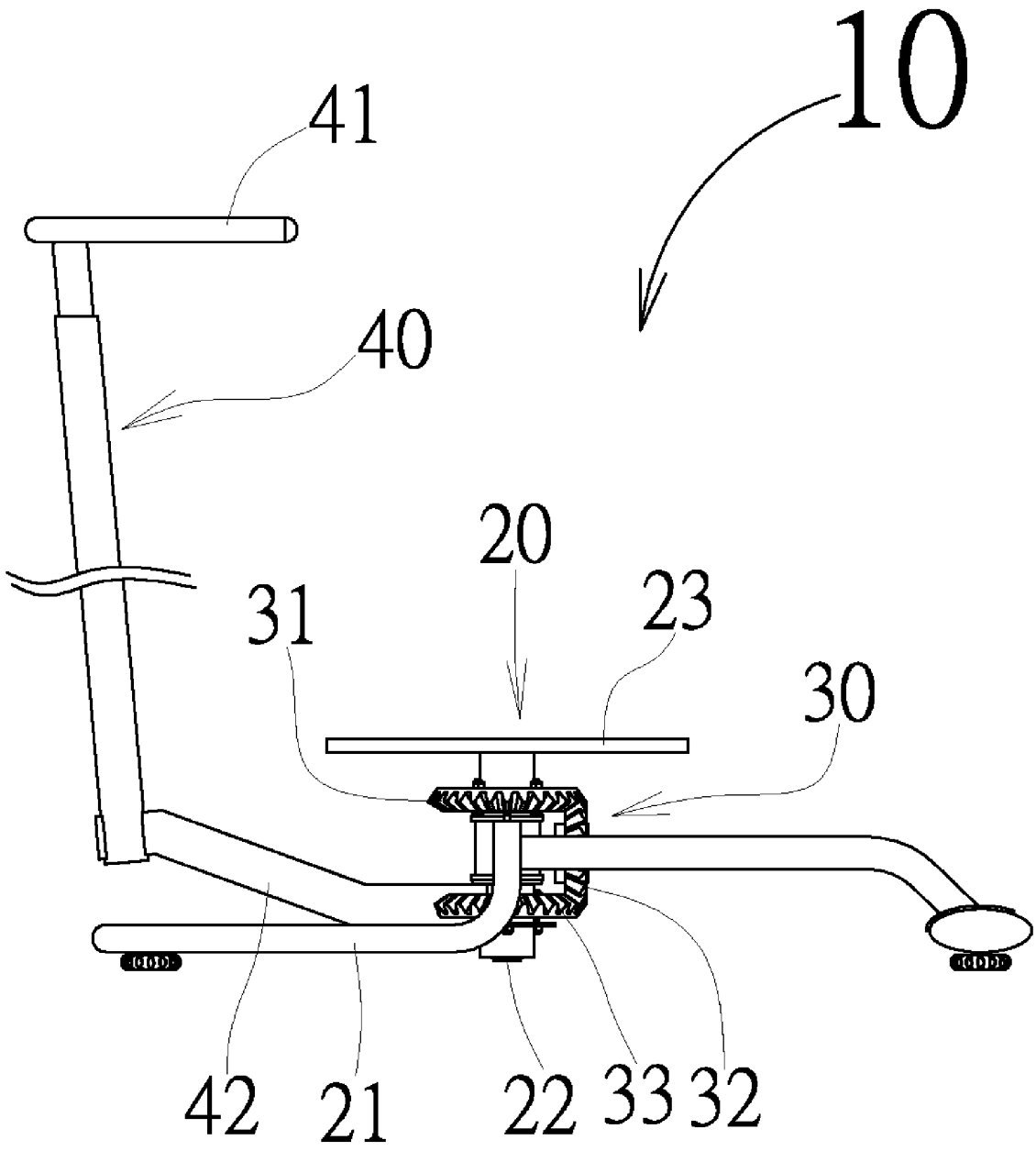
FIG. 2 is a side view of the preferred embodiment of the invention according to FIG. 1.
Figure 3:
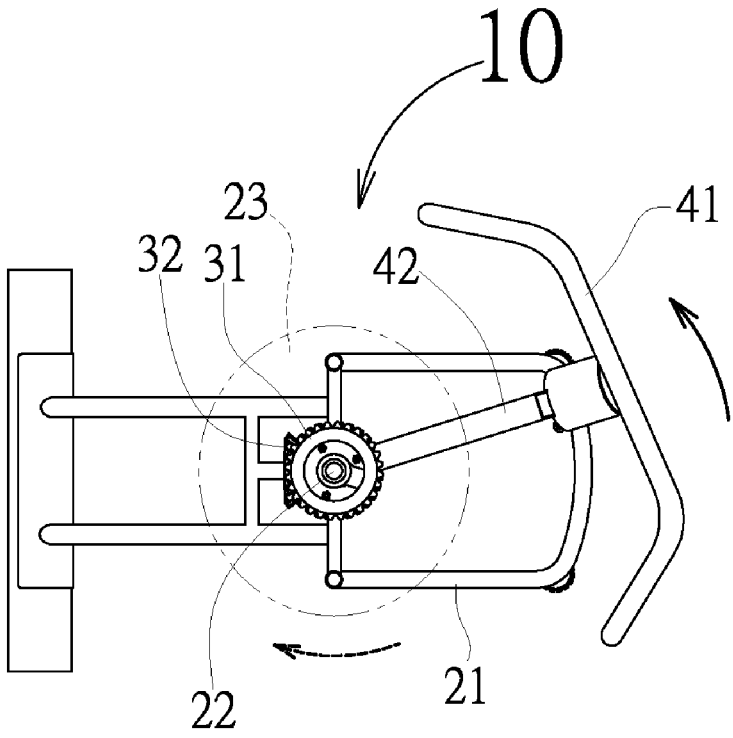
FIG. 3 is a schematic drawing of the preferred embodiment of the invention according to FIG. 1 wherein the operation thereof is illustrated.
Figure 4:
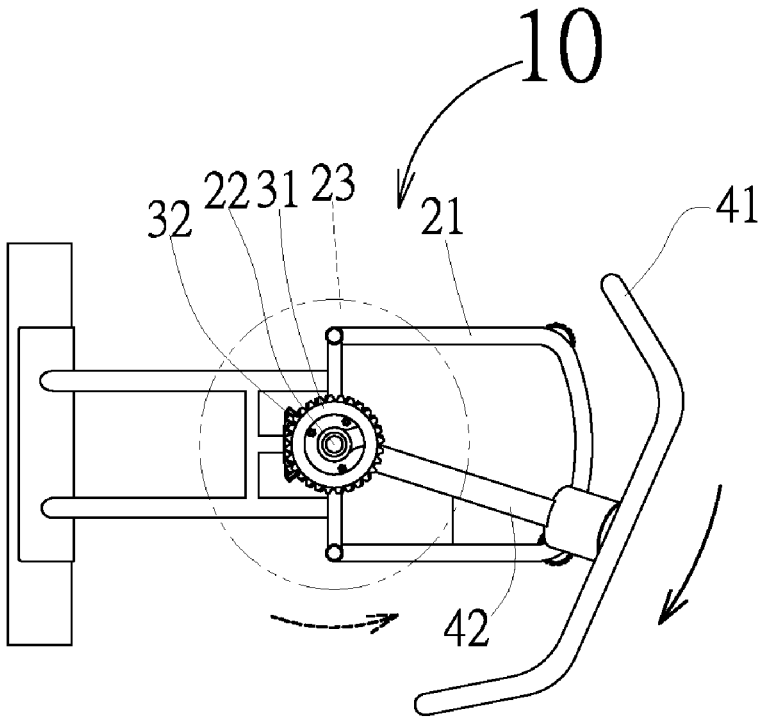
FIG. 4 is a schematic drawing of the preferred embodiment of the invention according to FIG. 1 wherein another operation thereof is illustrated.

Referring to FIGS. 1 through 4, an embodiment in accordance with the invention is applied to a waist-twisting exerciser 10 and includes a rotating disc mechanism 20, a coupling mechanism 30, and a rotating handlebar mechanism 40.

The rotating disc mechanism 20 includes a bottom base 21 and a supporting post 22 at the center thereof. A rotating disc 23 is pivotally attached to the top of the supporting post 22 for the lower limb of an operator to stand thereon.

The coupling mechanism 30 is driven by the rotating disc 23. The coupling mechanism 30 includes a primary bevel gear 31 in lateral direction, an intermediate bevel gear 32 extended in longitudinal direction and engaged with the primary bevel gear 31, and a secondary bevel gear 33 engaged with the intermediate bevel gear 32.

The rotating handlebar mechanism 40 includes a handlebar 41 at the top thereof for the upper limb of the operator to hold thereon. An upright rod transmission shaft 42 is attached to the bottom thereof and synchronically driven by the secondary bevel gear 33 in reverse rotation relative to the rotating disc mechanism 20.

Based on the assembly of the above-mentioned components, the handlebar 41 is synchronically rotated in reverse direction when the rotating disc 23 is subject to a force in rotation. In this way, the upper and lower bodies of the operator may achieve an expected synchronic twisting effect. Likewise, the rotating disc 23 may be reversely and synchronically rotated when the operator applies a force with his upper body to the handlebar 41 for a rotational motion.

By use of the special design of the invention, the operator may rotate on his backbone for taking a twisting exercise for his upper and lower bodies in reverse (different) direction. In this way, the operator may train his abdominal muscle group under the thoracic cavity and above the pelvis.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An exerciser for the sake of training the abdominal muscle group, wherein the operator is induced to twist his upper and lower bodies in opposite directions; and wherein the exerciser includes a coupling mechanism and a rotating disc mechanism for the lower limb of the operator to stand thereon and engaged with a first bevel gear of the coupling mechanism so as to be rotatable in a lateral direction, a rotating handlebar mechanism for the upper limbs of the operator to hold thereon and engaged with a second bevel gear of the coupling mechanism rotatable in the lateral direction, and the coupling mechanism further comprising an intermediate bevel gear engaged with the first and the second bevel gears for synchronically and reversely coupling the rotating disc mechanism and the rotating handlebar mechanism such that application of a rotational force to either the rotating disc mechanism or the rotating handlebar mechanism induces a synchronized reverse rotation in the other of the rotating handlebar mechanism and the rotating disc mechanism.

2. An exerciser for the sake of training the abdominal muscle group, comprising:

a) a rotating disc mechanism having:

a bottom base;

a supporting post at the center thereof, and a rotating disc being pivotally attached to the top of the supporting post for the lower limb of an operator to stand thereon;

b) a coupling mechanism driven by the rotating disc, the coupling mechanism having a primary bevel gear arranged in a lateral direction and engaged with the rotating disc such that the rotating disc and primary bevel gear are rotatable about the lateral direction, an intermediate bevel gear extended in a longitudinal direction and engaged with the primary bevel gear, and a secondary bevel gear engaged with the intermediate bevel gear, the secondary bevel gear rotatable about the lateral direction; and c) a rotating handlebar mechanism having a handlebar at the top thereof for the upper limb of the operator to hold thereon, an upright rod transmission shaft being attached to the bottom thereof and synchronically driven by the secondary bevel gear in reverse rotation relative to the rotating disc, wherein application of a rotational force to either the rotating disc or the rotating handlebar mechanism induces a synchronized reverse rotation in the other of the rotating handlebar mechanism and the rotating disc, whereby the operator may train his abdominal muscle group under the thoracic cavity and above the pelvis by twisting his upper and lower bodies in opposite directions.

* * * * *